US005485706A

United States Patent [19]

Menchetti

[11] Patent Number: 5,485,706

[45] Date of Patent: Jan. 23, 1996

[54] OFFSET FORMING OF STRUCTURAL COMPONENTS

[75] Inventor: Robert J. Menchetti, Buffalo, N.Y.

[73] Assignee: National Gypsum Company, Charlotte, N.C.

[21] Appl. No.: 278,559

[22] Filed: Jul. 21, 1994

Related U.S. Application Data

[63] Continuation of Ser. No. 20,969, Feb. 22, 1993, abandoned, which is a continuation-in-part of Ser. No. 858,797, Mar. 27, 1992, abandoned.

[51] Int. Cl.[6] ..... F04C 3/36

[52] U.S. Cl. ..... 52/731.5; 52/729.3; 52/731.7; 52/635; 52/282.1

[58] Field of Search ..... 52/731.7, 729, 52/281, 282.1, 731.1, 731.4, 731.5, 635

[56] References Cited

U.S. PATENT DOCUMENTS

| | | | |
|---|---|---|---|
| 1,545,168 | 7/1925 | Schenck | 52/729 |
| 1,598,129 | 8/1926 | Gersman | 52/635 |
| 2,065,493 | 12/1936 | Greulich | 52/729 |
| 2,076,472 | 4/1937 | London | 52/731.7 |
| 2,092,210 | 9/1937 | Greulich | 52/729 |
| 2,157,233 | 5/1939 | Geib, Jr. | 52/731.7 |
| 2,181,831 | 7/1939 | McLaughlin, Jr. | 52/731.1 X |
| 2,605,867 | 8/1952 | Goodwin . | |
| 3,349,535 | 10/1967 | Balinski . | |
| 3,362,056 | 1/1968 | Preller et al. | 52/729 |
| 3,381,439 | 5/1968 | Thulin, Jr. . | |
| 3,517,474 | 6/1970 | Lanternier | 52/729 |
| 4,011,704 | 3/1977 | O'Konski . | |
| 4,047,354 | 9/1977 | Sutherland . | |
| 4,109,440 | 8/1978 | Bill . | |
| 4,147,379 | 4/1979 | Winslow . | |
| 4,251,973 | 2/1981 | Paik | 52/729 |
| 4,364,212 | 12/1982 | Pearson et al. . | |
| 4,597,278 | 7/1986 | Hamada et al. . | |
| 4,852,325 | 8/1989 | Dunn et al. | 52/729 |
| 4,866,899 | 9/1989 | Houser | 52/729 |

FOREIGN PATENT DOCUMENTS

| | | | |
|---|---|---|---|
| 1095143 | 5/1955 | France | 52/729 |
| 0051685 | 1/1912 | Germany | 52/635 |

OTHER PUBLICATIONS

USG Cavity Shaft Wall, Area Separation Wall, Furring and Double Wall Components; 1992.

Domtar Gypsum 620 J Track and Slotted C–T Studs; 1994.

*Primary Examiner*—Carl D. Friedman

*Assistant Examiner*—Christopher Todd Kent

*Attorney, Agent, or Firm*—Marshall, O'Toole, Gerstein, Murray & Borun

[57] ABSTRACT

A laterally stiffened, elongate, roll-formed metal stud, or equivalent structural member having a central web with alternating deformed and undeformed portions.

16 Claims, 4 Drawing Sheets

OFFSET FORMING OF STRUCTURAL COMPONENTS

RELATED PATENT APPLICATION

This is a continuation of U.S. application Ser. No. 08/020,969, filed Feb. 22, 1993, now abandoned, which is a continuation-in-part of application Ser. No. 07/858,797, filed Mar. 27, 1992, now abandoned.

BACKGROUND OF THE INVENTION

This invention relates to structural components such as sheet metal studs, ceiling grid, furring channel, etc., and particularly to a reinforcing of the web sections of such structural components.

Sheet metal studs, T-bars for ceiling grid systems, furring channels and other sheet metal structural members all have web sections, or the like, which are formed from a single, continuous, elongate, narrow portion of sheet metal. These web sections are normally located between elongate flanges, or the like, which provide substantial longitudinal stiffness to the structural member. The flexibility of sheet metal results in these web sections clearly lacking in lateral stiffness. Webs with improved lateral stiffness would contribute considerably in providing an improved, more rigid structural member, providing improved structural performance and/or cost reduction through reduced metal usage.

SUMMARY OF THE INVENTION

The present invention consists of a sheet metal elongate structural element including a web section which has a plurality of offset sections, formed by shearing along a pair of lines extending generally crosswise of the elongate web, and deforming the metal between the sheared lines to produce a plurality of spaced-apart short sections which have a cross section which is essentially reverse of the original web cross-sectional configuration. This reverse configuration can be a mirror image of the original configuration, a 180° rotated type of reverse, or just generally disposed on an opposite side of a median plane. The cross section of the original configuration and the reverse configuration must include a portion of the structural element which includes a longitudinal bend in the cross section. The portion of the structural element which is sheared and deformed may include more than just the web, particularly when the web to be reinforced includes no longitudinal bends.

It is an object of the present invention to provide laterally stiffened, elongate sheet metal structural elements.

It is a further object to provide a means for producing elongate structural elements using less material and thus reducing weight and costs.

It is a still further object to provide a method of forming an improved, elongate sheet metal structural element.

BRIEF DESCRIPTION OF THE DRAWINGS

These and other objects and advantages will be more readily apparent when considered in relation to the preferred embodiments of the invention as set forth in the following specification and shown in the accompanying drawings in which.

DESCRIPTION OF THE PREFERRED EMBODIMENTS

The several embodiments of the present invention described hereinbelow all relate to elongate structural sheet material members, a typical embodiment being a metal stud 324, which is a single, elongate, roll-formed product made of about 0.020 -inch-thick, flexible sheet steel.

Figure 1:
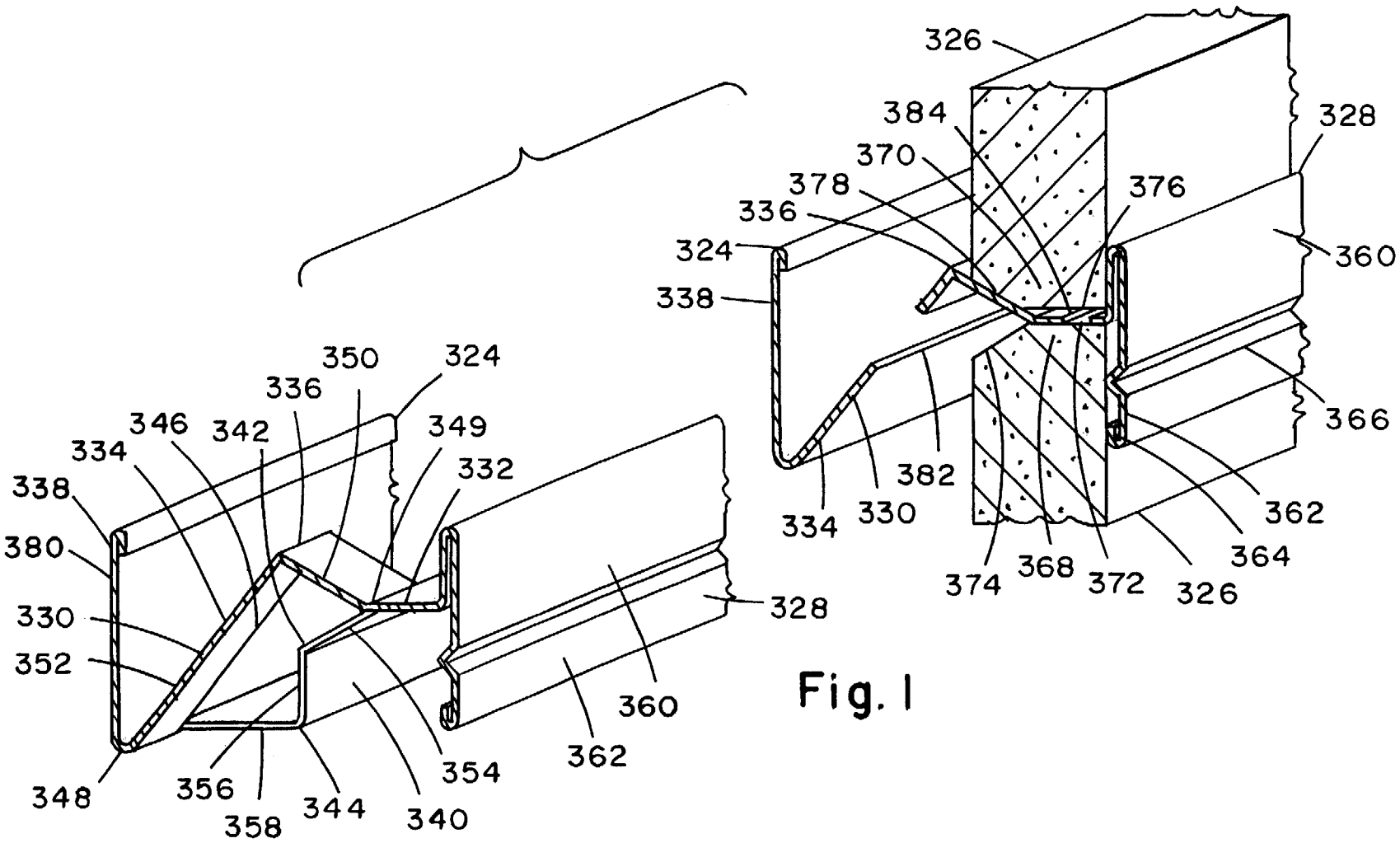
FIG. 1 is an isometric view of a portion of an elevator shaft enclosure wall including only a portion of a horizontal stud thereof disposed between portions of two core boards.

In a preferred embodiment, FIG. 1 shows horizontal studs 324 with two core boards 326, as used in an elevator shaft enclosure wall. The horizontal studs 324 and core boards 326 will typically be used by assembling them with corner posts, intermediate posts and door frame channels, none shown here, in a manner as fully disclosed in parent application, Ser. No. 07/858,797, which application is included herein by reference.

Horizontal stud 324 is an elongate, roll-formed sheet of metal with a cross section which includes an inner flange 328, a web 330 extending perpendicularly outwardly from the middle of inner flange 328 about ⅝ inch, forming a flat portion 332, whereat a major portion 334 of web 330 extends upwardly and outwardly about ⅝ inch to bend 336 and thence downwardly and outwardly to an upwardly extending outer flange 338. A minor portion 340 of web 330, about a 3-inch length of each foot of web, extends downwardly and outwardly about ⅝ inch to bend 342, thence downwardly to bend 344 and thence outwardly to upwardly extending outer flange 338.

Slits 346 were cut crosswise of web 330, during forming of horizontal stud 324, from the flat portion 332 to the outer flange 338. The slits 346 are preferably angled slightly to form minor portions 340 which have a shorter dimension along the outer flange bend 348 than along the bend 349, whereat the minor portion 340 is adjoined to the flat portion 332. By angling the slits 346, heat transfer through the stud, from one flange to the opposite flange is reduced, and, also, the studs are more easily stacked for warehousing and shipping.

The bend 336 divides the major portion 334 of web 330 into a ramp portion 350 and a connecting portion 352. The bends 342 and 344 divide the minor portion 340 into a bevel portion 354, a board holding portion 356 and a connecting portion 358.

Both ends of web major portion 334 and of web minor portion 340 are integrally connected to the stud; they have no free or dangling ends. Thus as shown in FIG. 1, web 330 has no tabs or any other part with a dangling or free end, all of which enhances the structural integrity of the web.

Inner flange 328 includes an upper double-thickness portion 360 and a lower single-thickness portion 362 which includes a lower hem 364 and a midway rib 366, both extending outwardly.

Horizontal stud 324 is mounted atop an upper edge portion 368 of one of the two core boards 326 in FIG. 1, and a lower edge portion 370 of the other core board 326 is disposed atop stud 324.

The upper edge portion 368 of the one core board 326 is held firmly between board holding portion 356 of web minor portion 340 and the hem 364 and rib 366 of single-thickness portion 362 of inner flange 328. Upper edge portion 368 has a flat top portion 372 and a bevelled portion 374 with an elongate corner therebetween of about 150°. Flat portion 372 abuts flat portion 332 of web 330. Bevelled portion 374 is parallel to and closely spaced from minor portion, bevel portion 354.

The lower edge portion 370 of the other core board 326 has a flat bottom portion 376, similar to flat top portion 372, and a bevelled portion 378 similar to bevelled portion 374. Flat bottom portion 376 is parallel to and closely spaced from flat portion 332 of web 330, and the junction of flat bottom portion 376 and bevelled portion 378 rests on ramp portion 350.

The core boards 326 are inserted onto each previously mounted horizontal stud 324 by merely sliding the bevelled portion 378 of lower edge portion 370 down the ramp portion 350 of the web 330 until the lower edge portion 370 abuts the double-thick portion 360 of inner flange 328. The lower edge portion 370 is held between the ramp portion 350 and inner flange 328 by the weight of the core board 326, plus the weight of all core boards 326 and horizontal studs 324 which are thereabove a part of the wall.

The horizontal studs 324 are forced onto the upper edge 368 of each core board 326 with the core board bevelled portion 374 guiding the stud web minor portion 340 so that upper edge 368 fits into the space between the inner flange 328 and the board holding portion 356.

Gypsum wide wallboard (not shown) is screw attached against the outer surfaces 380 of the outer flanges and to vertical posts (not shown).

In the preferred form of the invention, narrow, elongate slots 382 are arranged at spaced locations along the web 330, typically about three inches by ½ inch, spaced an inch apart, for reducing the heat conductivity through a wall, in case of fire on one or the other sides of the wall. Also, horizontal stud 324 could have 3/16-inch by 2¼-inch vent holes 384 added, with ¾-inch spacing.

Figure 3:
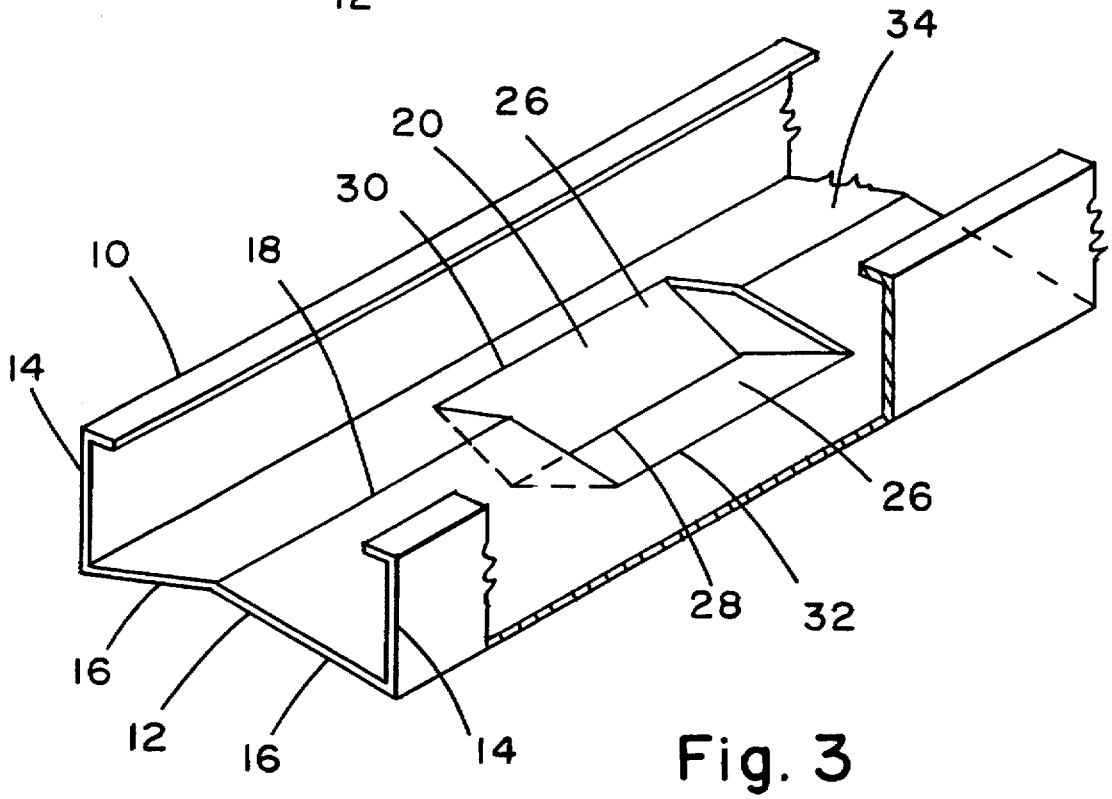
FIG. 3 is an isometric view of the section of stud of FIG. 2 after being deformed.

Referring next to FIG. 3, there is shown a modification of the invention, wherein a metal screw stud 10 has a web 12 and two spaced, parallel flanges 14. Web 12 includes two web halves 16, each angled upwardly from an adjacent flange 14 and joined along a ridge 18.

The web 12 also has a plurality of reversely directed, deformed portions 20, about a 3-inch length of each foot of web (only one deformed portion 20 being shown), extending downwardly from the generally upwardly directed web 12.

Figure 2:
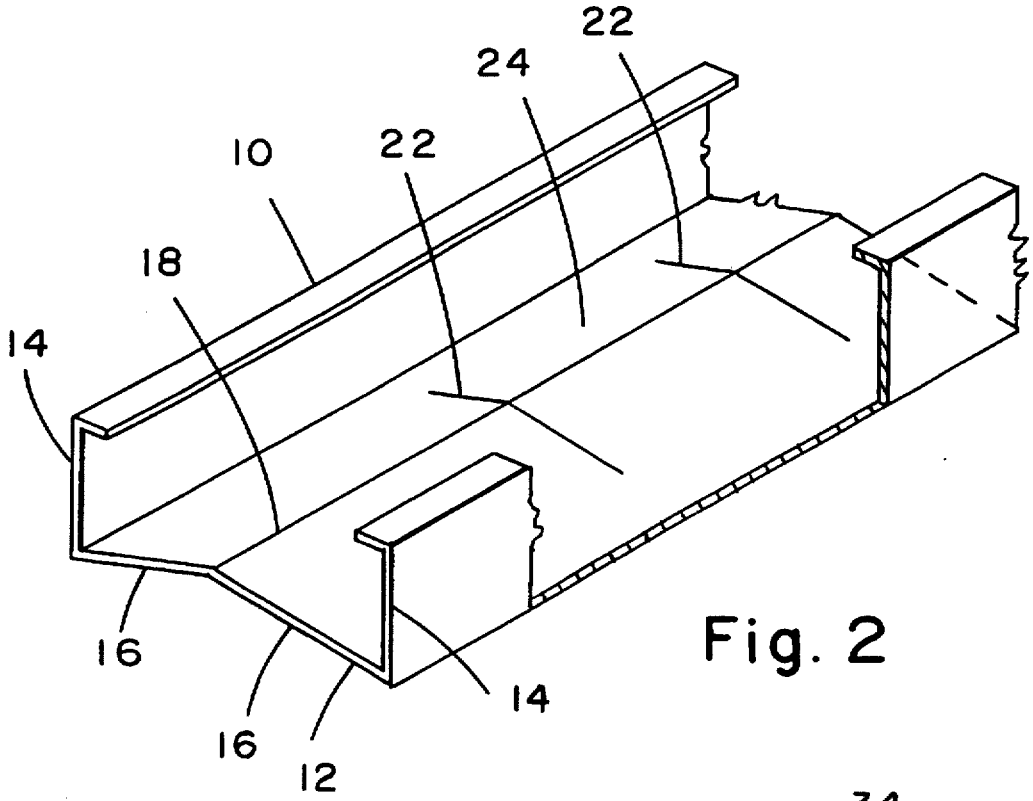
FIG. 2 is an isometric view of a short action of a metal screw stud which has been sheared, preparatory to being deformed, in accordance with the invention.

Referring to FIG. 2, stud 10 is shown unfinished, with slits 22 extending crosswise of web 12, defining a pre-bent portion 24 of web 12 to be bent downwardly to form a deformed portion 20. In the preferred form, deformed portion 20 includes two deformed portion halves 26, each angled downwardly and joined along a ridge 28. As will be seen in FIGS. 2 and 3, deformed portion 20 is the reverse of pre-bent portion 24.

As will also be seen in FIGS. 2 and 3, the bending to create deformed portion 20 results in two longitudinal bends 30, 32, which with the lateral slits 22, define the perimeter of the deformed portion. It is essential, in accordance with the invention, that the slits of any embodiment have a substantial lateral extent. An important consideration in regard to the amount of improvement to be provided by the present invention is in the extent to which the deformed portion is moved across an imaginary plane extending through the two longitudinal bends 30, 32. If only a minor portion of the deformed portion is on the opposite side of this imaginary plane, little or no stiffening will be effected, thus requiring that a major portion of the deformed portion of any embodiment of the invention be on the opposite side of this imaginary plane relative to the undeformed portion. Also, the degree of stiffening provided increases with the increase in the distance of the undeformed portion and the deformed portion from this imaginary plane.

In the embodiment of FIG. 3, the undeformed portions 34 of the web 12, that which remains with the original cross section, like the pre-bent portion 24, is the major portion of web 12, and only a minor portion, the deformed portion 20, has the reversed, deformed cross section. It is, however, contemplated that the deformed portions 20 could be the major portion and the undeformed portions 34 could be the minor portion, or the two portions could be equal.

Figure 4:
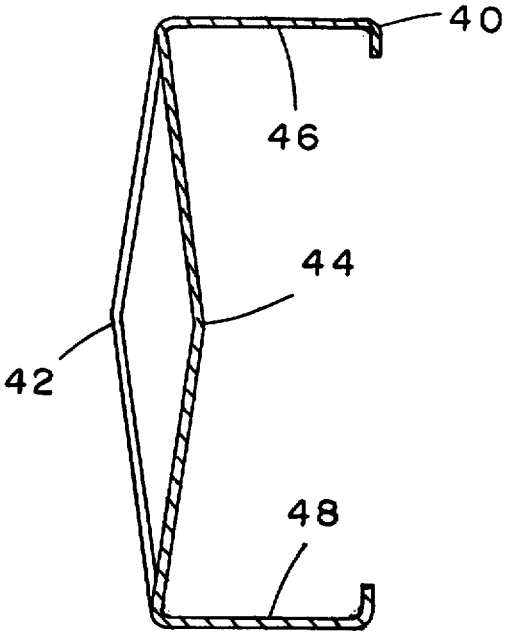
FIGS. 4 and 5 are cross-sectional end views of two modifications of a screw stud embodying the invention.

Referring to FIG. 4, a stud 40 is shown, similar to stud 10, except that the deformed portion 42 extends completely across the web 44, reaching from one flange 46 to the other flange 48.

Figure 5:
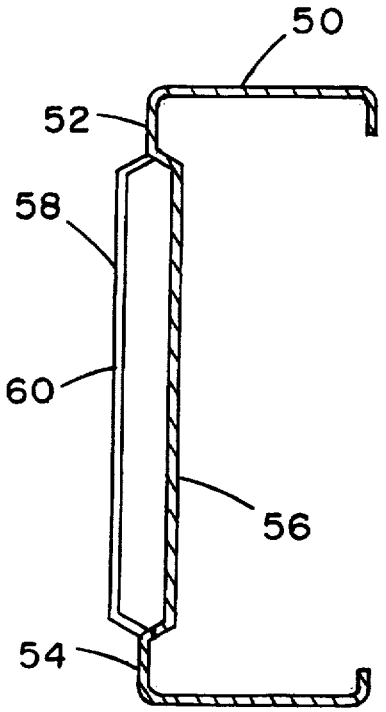

In FIG. 5, a stud 50 is shown having an undeformed portion 52 of web 54 which includes a raised, flat midsection 56, and a deformed portion 58 which includes a depressed, flat midsection 60.

Figure 6:
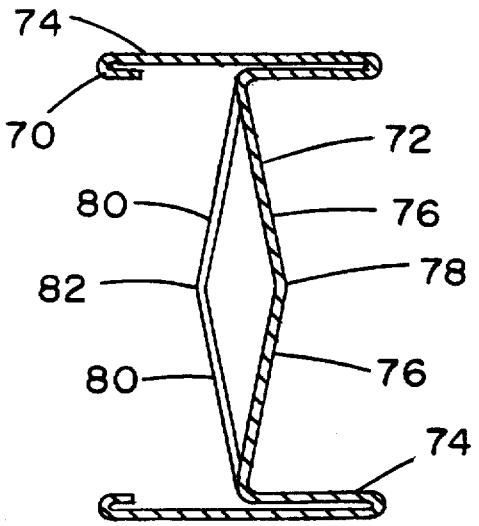
FIGS. 6–9 are cross-sectional end views of four modifications of an I-stud all embodying the invention.

FIG. 6 shows the cross section of an I-stud 70 with a web 72 and two flanges 74. Web 72 includes two upwardly inclined web halves 76, in an undeformed portion 78, and two downwardly inclined halves 80 in a deformed portion 82.

Figure 7:
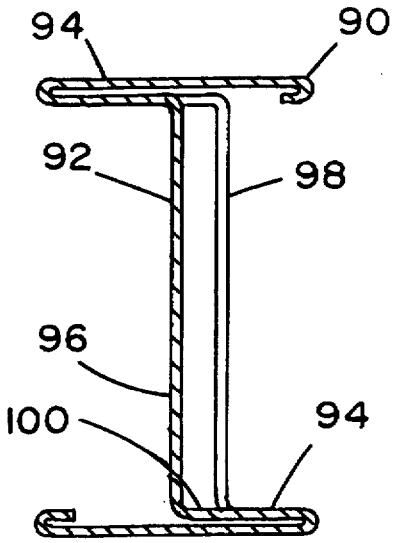

FIG. 7 shows the cross section of an I-stud with a web 92 and two flanges 94. Web 92 includes an undeformed portion 96 which is flat and extends from one flange 94 to the other flange 94. Web 92 also includes a deformed portion 98 which is displaced out of the plane of undeformed portion 96 to a parallel plane by folding back a small segment 100 of one flange 94, where the web 92 joins the one flange 94.

Figure 8:
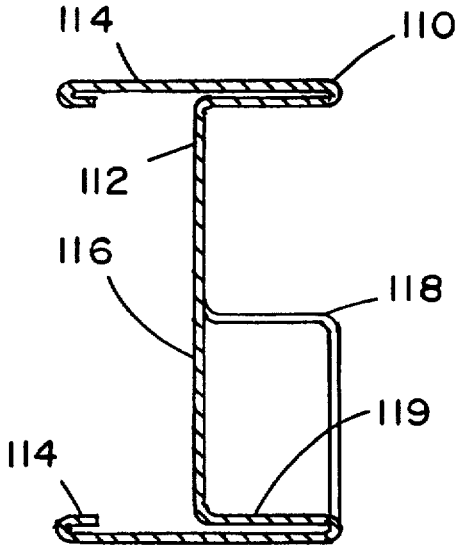

FIG. 8 shows the cross section of an I-stud 110, with a web 112 and two flanges 114. Web 112 includes an undeformed portion 116 which is flat and extends from one flange 114 to the other flange 114. Web 112 also includes a deformed portion 118 which is displaced out of the plane of undeformed portion 116 from the center of web 112 to one flange 114, by bending inwardly an inner layer 119 of the double-thickness part of the one flange 114.

Figure 9:
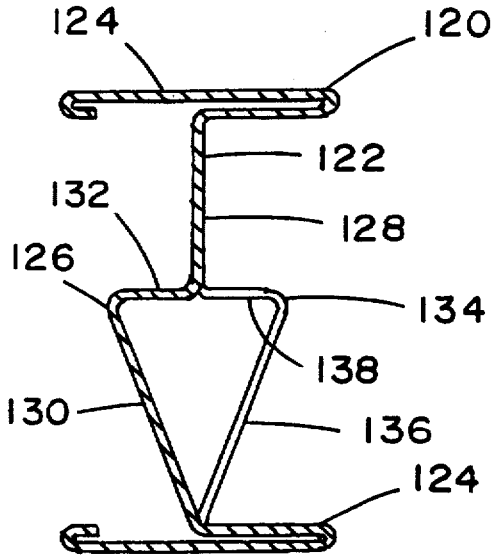

FIG. 9 shows the cross section of a modified I-stud 120 with a web 122 and two flanges 124. Web 122 includes an undeformed portion 126 which includes three sections, a flat section 128 extending away from the center of one flange 124, an angled section 130 extending angularly away from the center of the opposite flange 124 and a mid-wall section 132, parallel to the flanges 124 connecting the flat section 128 and the angled section 130 and the center of the stud 120. Web 122 also includes a deformed portion 134 which also includes an angled section 136 and a mid-wall section 138, with the angled section 136 also extending angularly away from the center of the opposite flange 124, but in the opposite angular direction from that of angled section 130.

Figure 10:
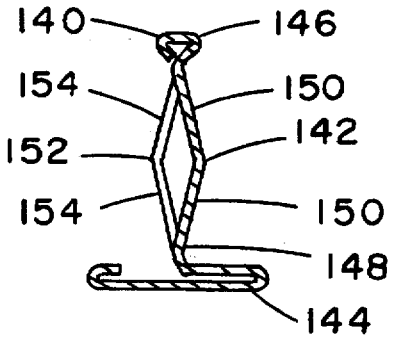
FIGS. 10 and 11 are cross-sectional end views of two modifications of a ceiling grid T-bar embodying the invention.

FIG. 10 shows the cross section of a ceiling grid T-bar 140 with a web 142, a bottom flange 144 and a top bulb 146. Web 142 includes an undeformed portion 148 which includes two outwardly angled halves 150 extending from flange 144 to bulb 146. Web 142 also includes a deformed portion 152 which includes two inwardly angled halves 154 extending from flange 144 to bulb 146.

Figure 11:
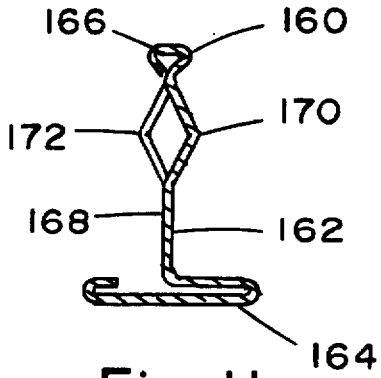

FIG. 11 shows the cross section of a ceiling grid T-bar 160 with a web 162, a bottom flange 164 and a top bulb 166. Web 162 includes a vertical lower half 168, an undeformed outwardly formed ridge portion 170 and a deformed inwardly formed ridge portion 172.

Figure 12:
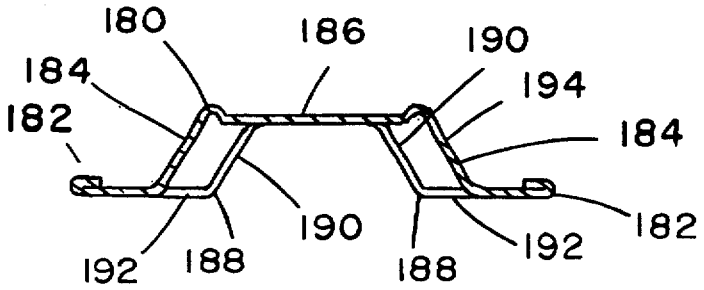
FIG. 12 is a cross-sectional end view of a furring channel embodying the invention.

FIG. 12 shows a furring channel 180, including two outwardly directed, horizontal bottom flanges 182, two undeformed upwardly and inwardly angled side wall portions 184 and an undeformed horizontal web 186. Furring channel 180 also includes two series of deformed portions 188, each of which includes a deformed side wall portion 190 and a deformed horizontal portion 192. Deformed portions 188 will be seen to be formed in a reverse cross-sectional shape relative to the cross sections of the undeformed portions 194 from which they were deformed.

In all of the above described embodiments, it is contemplated that the deformed portions will have been created by the method described relative to the embodiment of FIGS. 2 and 3, including shearing along crosswise lines and deforming the material between the sheared lines, creating a deformed section which is to a substantial degree a reverse cross-sectional configuration compared to undeformed cross-sectional configuration. It is further contemplated that, although the preferred embodiments will include about one deformed portion per elongate foot of structural element, that this may be varied to about one deformed portion per inch to about one deformed portion per two or three feet, with the lengths of the deformed portions and undeformed portions both being anywhere from about ½ inch to about 2 feet, alternating throughout the total length of the structural element.

Also, in all embodiments described, it will be noted that the deformed portions were all deformed to the opposite side of an imaginary plane through the bend lines as discussed relative to the embodiment of FIG. 3.

Also, in all embodiments, it will be noted that the deformed and undeformed portions were located in an elongate central portion, whether it be in a central web portion or a web portion plus part of an adjacent flange portion, which adjacent flange portion is in a sense part of a central portion since there is additional flange portions more remote from the embodiment's center. Described another way, the slits which partly define a deformed portion never extend to a lateral edge of the sheet material from which any embodiment is formed. Also, the deformed portions always include two bends which partly define the deformed portion, whereby the deformed portion is always integrally connected to the rest of the embodiment at both lateral ends.

Having completed a detailed description of the preferred embodiments of my invention so that those skilled in the art may practice the same, I contemplate that variations may be made without departing from the essence of the invention.

I claim:

1. An elongate, structural, sheet metal member for use with flat boards having edges, comprising an elongate, narrow strip of sheet metal formed into an elongate structural member, said strip of sheet metal including at least three elongate sections, including a central web section between two side flange sections, said two flange sections being substantially parallel, and said web section extending between and connecting said flange sections, said central web section comprising a substantially flat portion attached to one of said flanges and extending substantially perpendicular to said flanges and a plurality of alternating deformed portions and undeformed portions angling in opposite directions between said flat portion and the other of said flanges, said deformed portions each being defined by a pair of substantially lateral slits and a pair of substantially longitudinal bends, said lateral slits having an extent generally perpendicular to the elongate extent of said structural member, said deformed portions including a major portion thereof disposed on an opposite side of an imaginary plane extending through said bends from said undeformed portions, whereby added stability is provided by said deformed portions, and board receiving spaces being formed between said one of said flanges and both sides of said flat portion.

2. An elongate member as defined in claim 1, wherein said sheet metal is roll-formed sheet steel.

3. An elongate member as defined in claim 2, wherein said sheet steel is about 0.020-inch thick.

4. A formed, elongate sheet metal stud comprising an elongate sheet metal inner flange, an elongate sheet metal outer flange which is parallel to said inner flange, and an elongate sheet metal web extending laterally between and joining said inner and outer flanges, said web comprising a substantially flat portion extending substantially perpendicularly to said inner flange, and a plurality of longitudinally alternating upper and lower integral web parts each extending laterally between and joined to said flat portion and to said outer flange, said upper and lower integral web parts being angled in opposite directions from said flat portion, and a plurality of laterally extending slits each separating adjacent upper and lower parts.

5. The method of making a laterally stiffened, elongate sheet metal structural member comprising forming an elongate sheet metal member having a continuous cross section including a central web and two side flanges connected by said web, said flanges being formed parallel with each other, forming a substantially flat portion of said web adjacent one of said flanges, said flat portion being perpendicular to said flanges, cutting a pair of spaced-apart slits extending laterally across said central web between said flat portion and the other of said flanges, and deforming the portions of said central section between said slits to form alternating deformed and undeformed portions which angle oppositely from said flat portion, at least one of said deformed and undeformed portions forming a pocket between said one flange, said flat portion and said central section.

6. The method of claim 5, wherein said deforming step includes bending said member along a longitudinally extending bend at each side of said deformed portion.

7. The method of claim 6, wherein forming said deformed portion involves forcing sheet metal from one side of a plane common to said two lateral bends to the opposite side of said plane.

8. The method of claim 7, wherein a major portion of said forced sheet metal is forced to said opposite side.

9. The method of claim 5, wherein a plurality of said deformed portions are formed with alternating undeformed portions therebetween.

10. The method of claim 9, wherein said deformed portions are deformed to a cross section which is shaped substantially reverse of a cross section of said undeformed portions.

11. An elongate, substantially constant thickness sheet metal structural member having side edges and a cross sectional roll formed shape between said side edges, said formed shape comprising first and second side parts adjacent said side edges and a central web connecting said side parts, at least one of said side parts comprising a flange which extends the entire length of said member, said central web including a major portion, at least one pair of slits formed in said major portion, said slits having ends terminating short of said side edges and said slits extending to said flange, said web including a minor portion between said pair of slits and extending to said flange, said minor portion being bent at said ends of said slits and extending out of alignment with said major portion, said minor portion comprising a first section and a second section connected to said first section, said first section extending from said flange to said second section and said second section being connected to said major portion, and said second section extending parallel to said flange and said first section extending at an angle to said flange.

12. A structural member as set forth in claim 11, wherein said central web of said formed shape further includes a substantially flat portion between said slits and the other of said side parts, said flat portion extending substantially perpendicular to said flange.

13. A structural member as set forth in claim 11, wherein the other of said side parts comprises a flange which is substantially parallel with said first-mentioned flange.

14. A structural member as set forth in claim 11, wherein an imaginary plane extends through said ends of said slits, said major portion extending on one side of said plane and said minor portion extending on the other side of said plane.

15. A structural member as set forth in claim 11, wherein said formed shape and said minor portion each has a bend between said ends of said slits.

16. A structural member as set forth in claim 11, wherein said first section extends at an angle of 90° to said flange.

* * * * *